US008381905B1

(12) United States Patent
Kao

(10) Patent No.: US 8,381,905 B1
(45) Date of Patent: Feb. 26, 2013

(54) BURGLARPROOF BIT SOCKET BRACKET ASSEMBLY

(76) Inventor: Jui-Chien Kao, Taichung (TW)

( * ) Notice: Subject to any disclaimer, the term of this patent is extended or adjusted under 35 U.S.C. 154(b) by 0 days.

(21) Appl. No.: 13/299,726

(22) Filed: Nov. 18, 2011

(51) Int. Cl.
*B65D 85/28* (2006.01)
*A47F 7/00* (2006.01)

(52) U.S. Cl. ..... 206/378; 206/1.5; 206/493; 206/807; 211/70.6

(58) Field of Classification Search ..... 206/1.5, 206/378, 493, 806, 807; 211/70.6
See application file for complete search history.

(56) References Cited

U.S. PATENT DOCUMENTS 5,740,911 A * 4/1998 Chou ..... 206/378
5,862,913 A * 1/1999 Chou ..... 206/378
5,975,297 A * 11/1999 Kao ..... 206/378
6,032,797 A * 3/2000 Kao ..... 206/378
6,092,656 A * 7/2000 Ernst ..... 206/378
6,415,933 B1 * 7/2002 Kao ..... 211/70.6
6,669,032 B2 * 12/2003 Kao ..... 211/70.6
6,854,594 B2 * 2/2005 Vasudeva et al. ..... 206/1.5
7,264,213 B2 * 9/2007 Liu ..... 206/378
2009/0145865 A1 * 6/2009 Yu ..... 211/70.6
2010/0170817 A1 * 7/2010 Wu ..... 206/378

* cited by examiner

*Primary Examiner* — Bryon Gehman
(74) *Attorney, Agent, or Firm* — C. G. Mersereau

(57) ABSTRACT

A bit socket bracket assembly has a frame, multiple bit socket mounts and a burglarproof unit. The frame has a track. Each bit socket mount is detachably and slidably connected with the track and has a hollow positioning section. Each positioning section has a round cross section and can be inserted into a bit socket. The cross sections of the positioning sections are round, so the bit sockets can be rotated. Accordingly, a number or a sign on each bit socket can be rotated to face a user and this is greatly practical and convenient.

2 Claims, 9 Drawing Sheets

BURGLARPROOF BIT SOCKET BRACKET ASSEMBLY

BACKGROUND OF THE INVENTION

1. Field of the Invention

The present invention relates to a bit socket bracket assembly, and more particularly to a bit socket bracket assembly allowing bit sockets to be rotated.

2. Description of Related Art

A conventional bit socket bracket assembly has a frame and multiple bit socket mounts connected with the frame. Each bit socket mount has a connecting section and a positioning section connected integrally with the connecting section. The positioning section of each bit socket mount has a rectangular cross section. Nevertheless, the positioning sections cannot allow bit sockets to be rotated. Consequently, a number or a sign on each bit socket cannot be rotated to face a user and this is not practical and convenient.

To overcome the shortcomings, the present invention tends to provide a bit socket bracket assembly to mitigate the aforementioned problems.

SUMMARY OF THE INVENTION

The main objective of the invention is to provide a bit socket bracket assembly allowing bit sockets to be rotated.

A bit socket bracket assembly has a frame, multiple bit socket mounts and a burglarproof unit. The frame has a track. Each bit socket mount is detachably and slidably connected with the track and has a hollow positioning section. Each positioning section has a round cross section and can be inserted into a bit socket. The cross sections of the positioning sections are round, so the bit sockets can be rotated. Accordingly, a number or a sign on each bit socket can be rotated to face a user and this is greatly practical and convenient.

Other objects, advantages and novel features of the invention will become more apparent from the following detailed description when taken in conjunction with the accompanying drawings.

DETAILED DESCRIPTION OF PREFERRED EMBODIMENT

Figure 1:
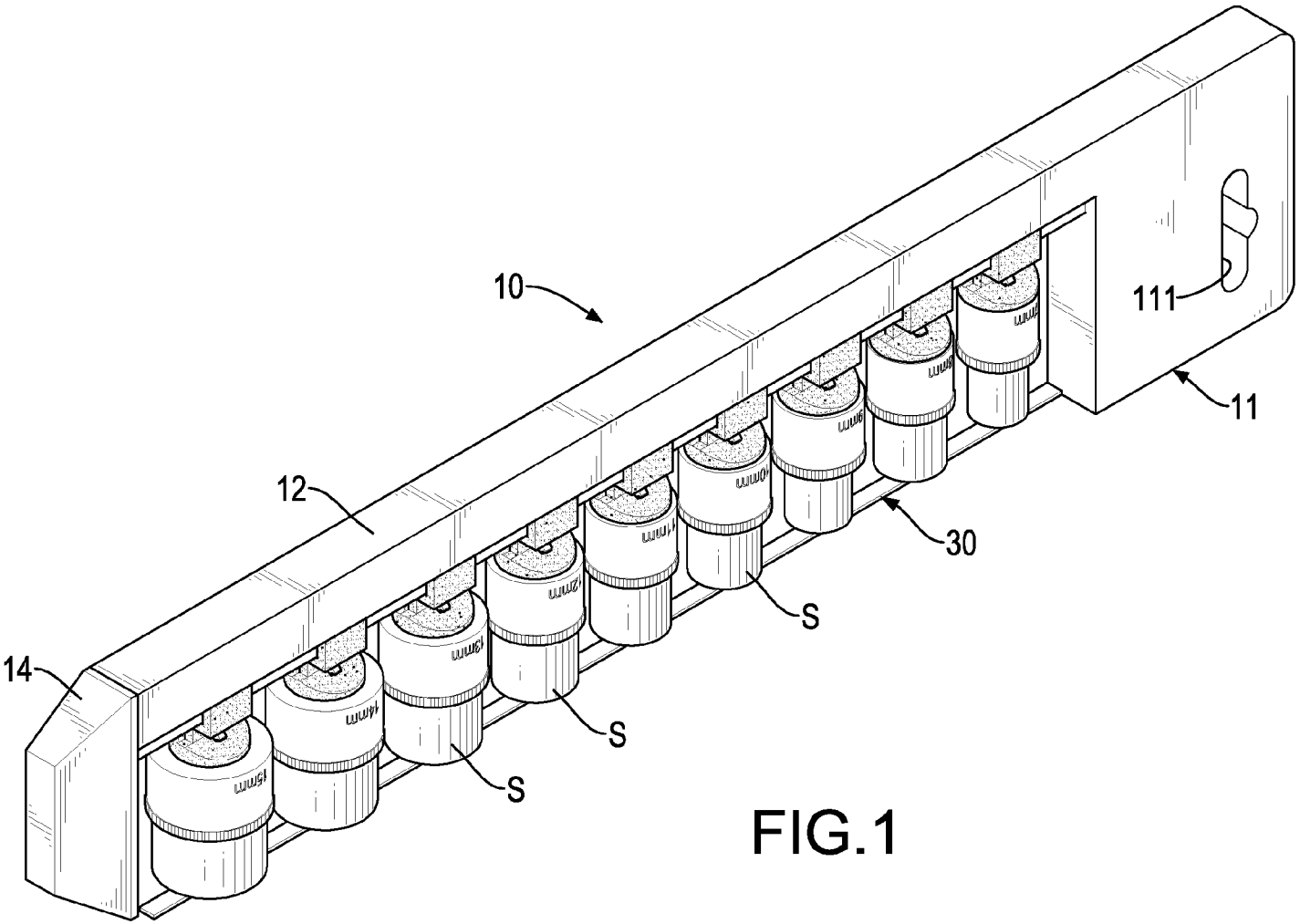
FIG. 1 is a perspective view of a bit socket bracket assembly in accordance with the present invention.
Figure 2:
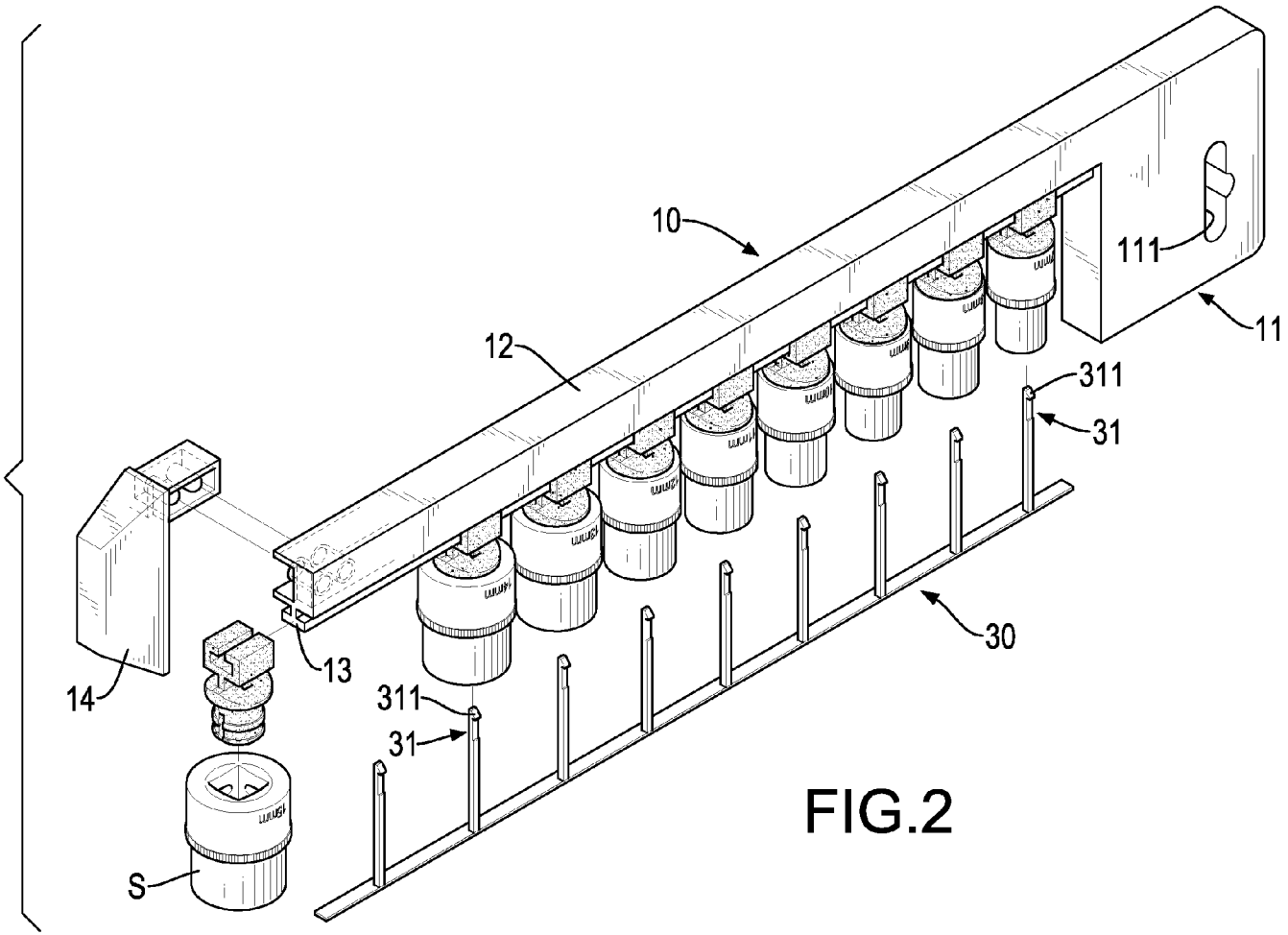
FIG. 2 is a partially exploded perspective view of the bit socket bracket assembly in FIG. 1.
Figure 3:
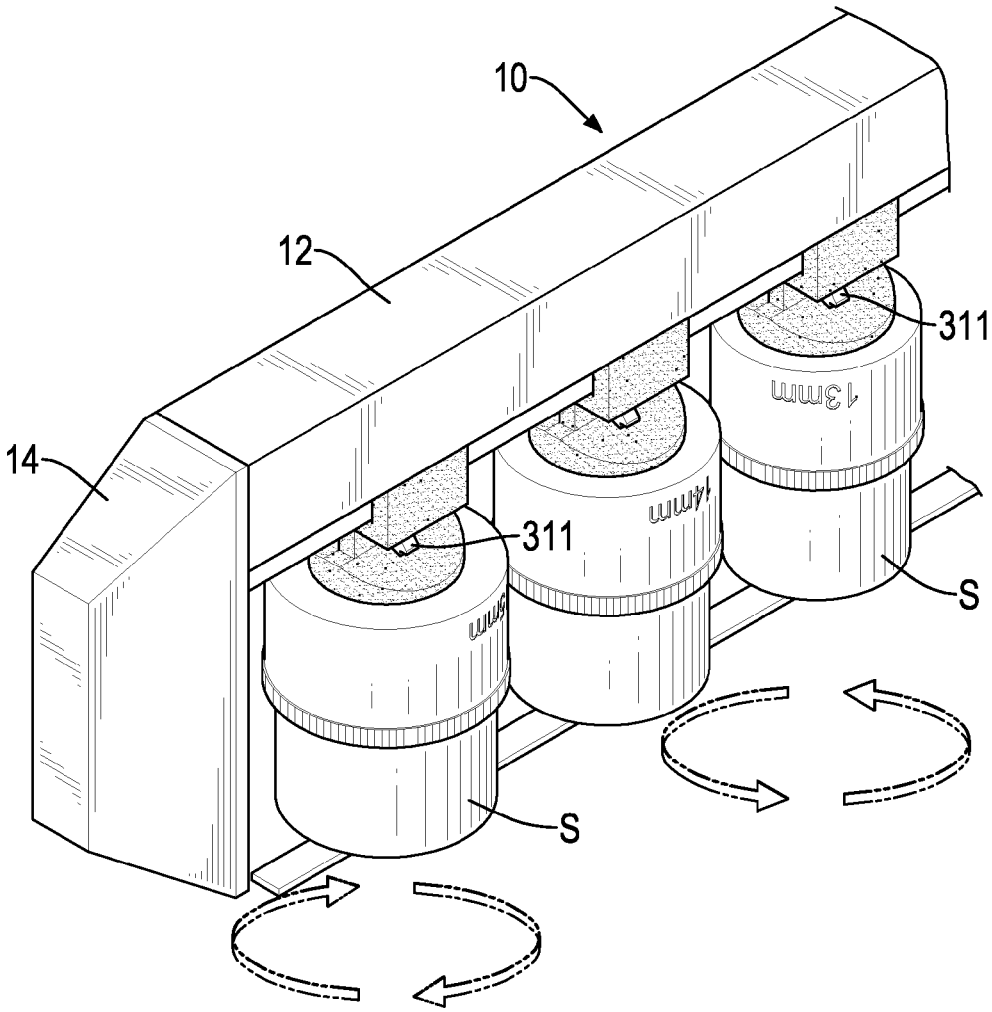
FIG. 3 is an enlarged perspective and operational view of the bit socket bracket assembly in FIG. 1.

With reference to FIGS. 1 to 3, a bit socket bracket assembly in accordance with the present invention comprises a frame 10, multiple bit socket mounts 20 and a burglarproof unit 30.

The frame 10 has a base 11, an arm 12, a track 13 and a detachable member 14. The base 11 has a hanging hole 111 formed through the base 11. The arm 12 is elongated and is integrally connected with the base 11. The track 13 is integrally connected with the arm 12. A length of the track 13 is the same as that of the arm 12. The detachable member 14 is detachably connected with a distal end of the arm 12.

With further reference to FIGS. 4 to 9, the bit socket mounts 20 are detachably connected with the frame 10. Each bit socket mount 20 has a connecting section 21 and a hollow positioning section 22.

Take one bit socket mount 20 for example. The connecting section 21 is slidably mounted on the track 13. The positioning section 22 is hollow, is integrally connected with the connecting section 21 and has an end surface, an outer surface, a cross section, a recess 221, a rib 222 and two grooves 223. The end surface of the positioning section 22 is opposite to the connecting section 21. The cross section of the positioning section 22 is round.

The recess 221 is axially formed in the end surface of the positioning section 22 and has a cross section, an opening 2211 and a bottom 2212. The cross section of the recess 221 is round. The bottom 2212 of the recess 221 is opposite to the opening 2211 of the recess 221 and is adjacent to the connecting section 21.

The rib 222 is annular and is formed around the outer surface of the positioning section 22.

The two grooves 223 are formed in the end surface of the positioning section 22, communicate with the recess 221 and are respectively located at two opposite sides of the positioning section 22. One of the two grooves 223 of the positioning section 22 is formed through the rib 222.

Figure 4:
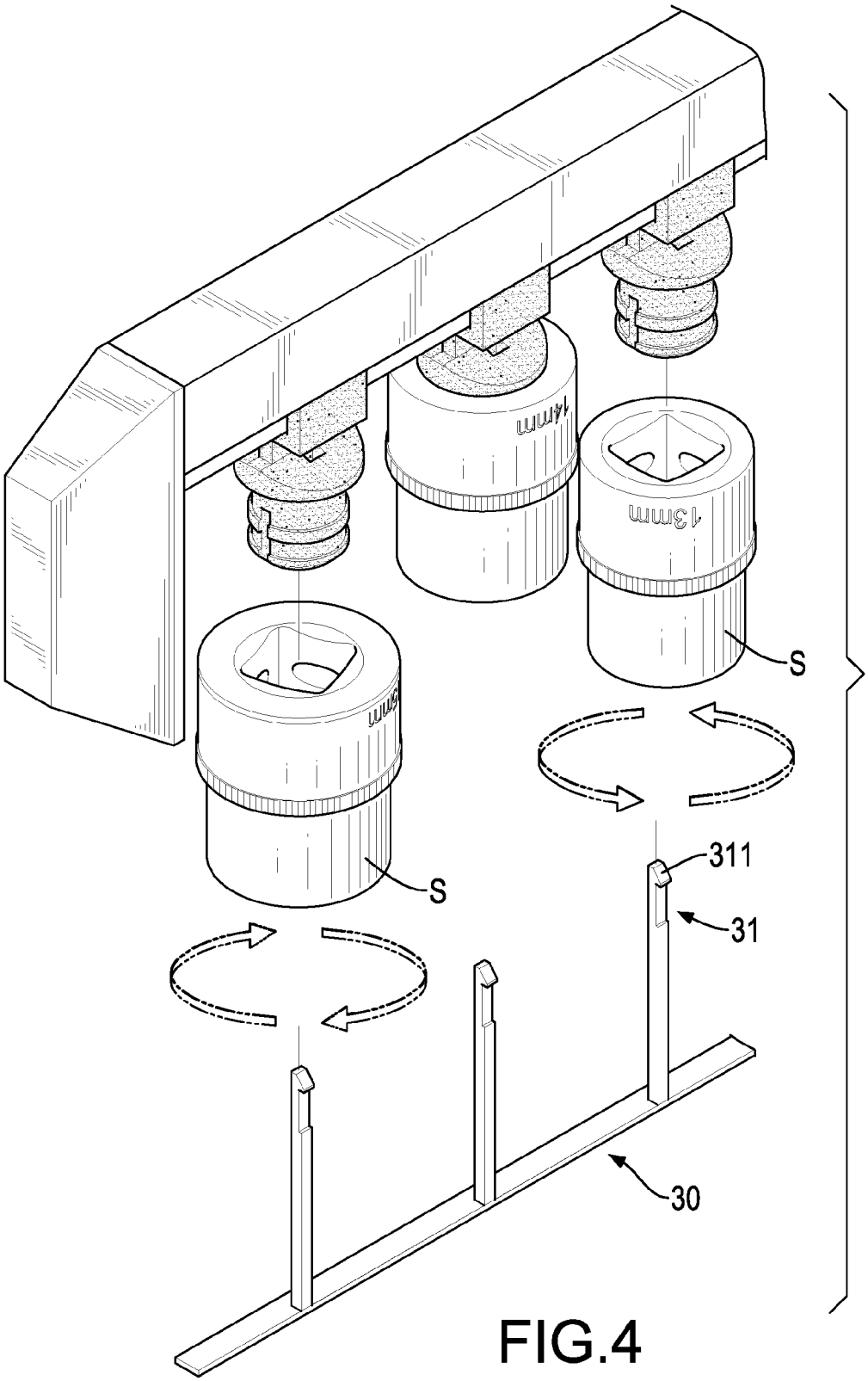
FIG. 4 is an enlarged exploded perspective view of the bit socket bracket assembly in FIG. 3.
Figure 5:
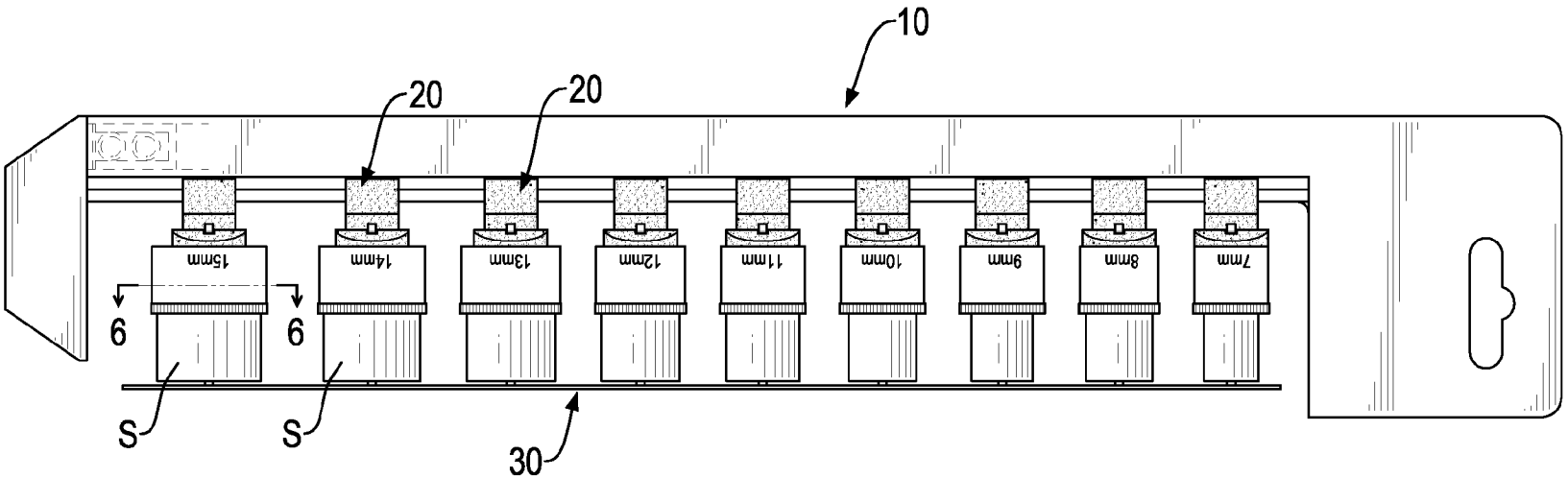
FIG. 5 is a side view of the bit socket bracket assembly in FIG. 1.
Figure 6:
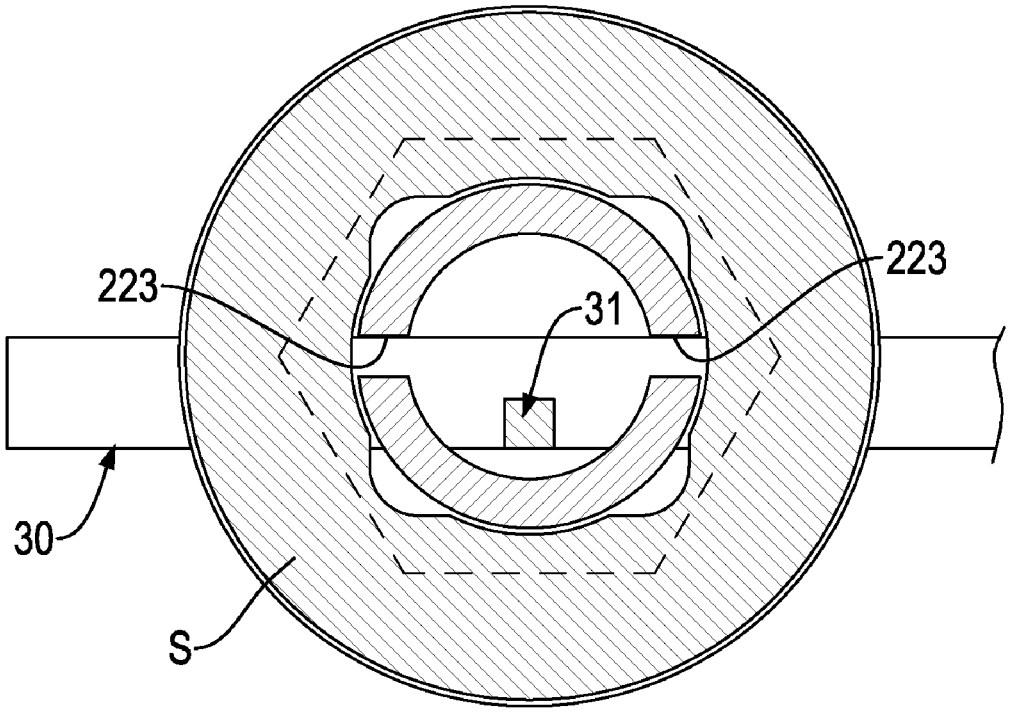
FIG. 6 is an enlarged cross sectional view of the bit socket bracket assembly in FIG. 5 along line 6-6.
Figure 7:
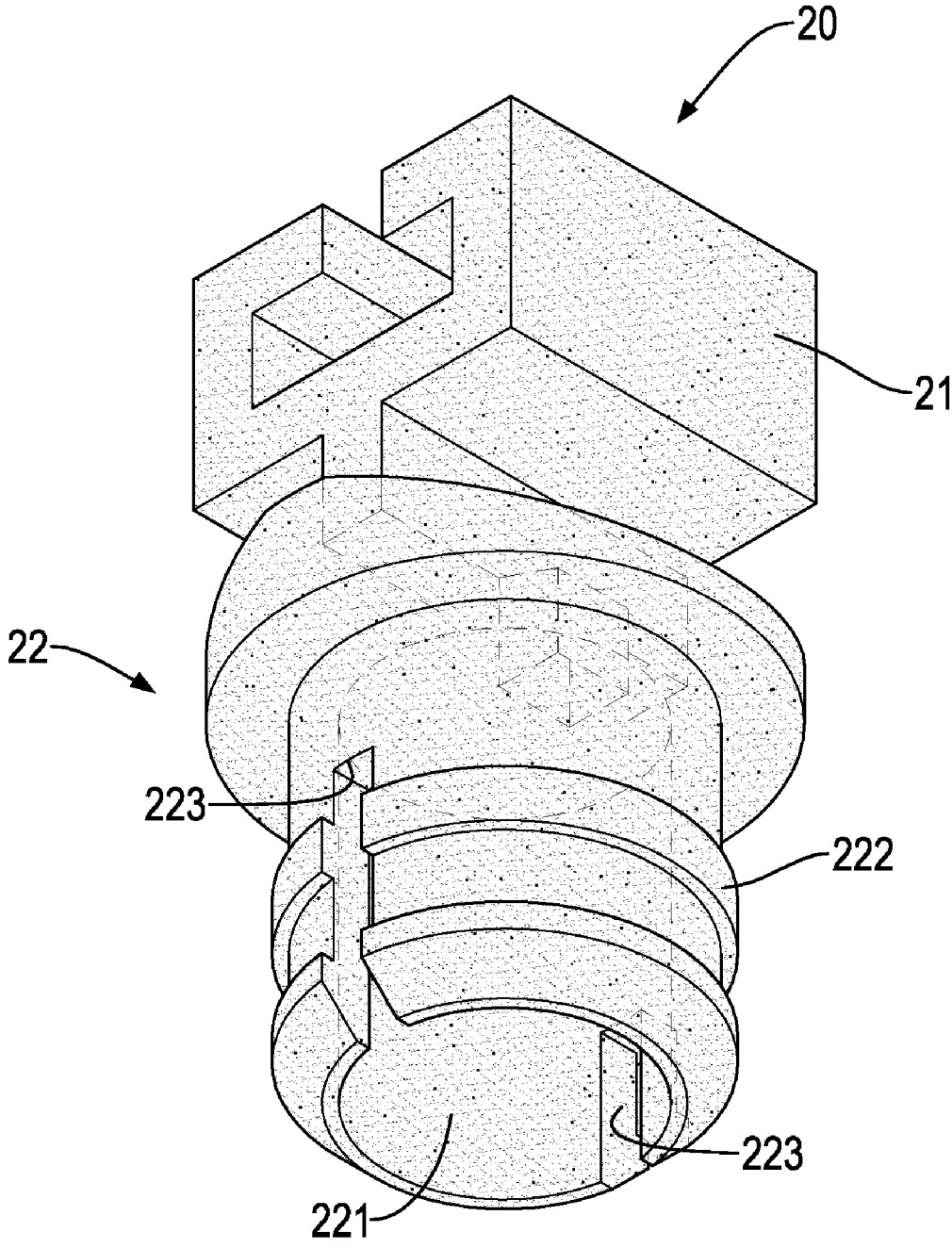
FIG. 7 is an enlarged perspective view of a bit socket mount of the bit socket bracket assembly in FIG. 1.
Figure 8:
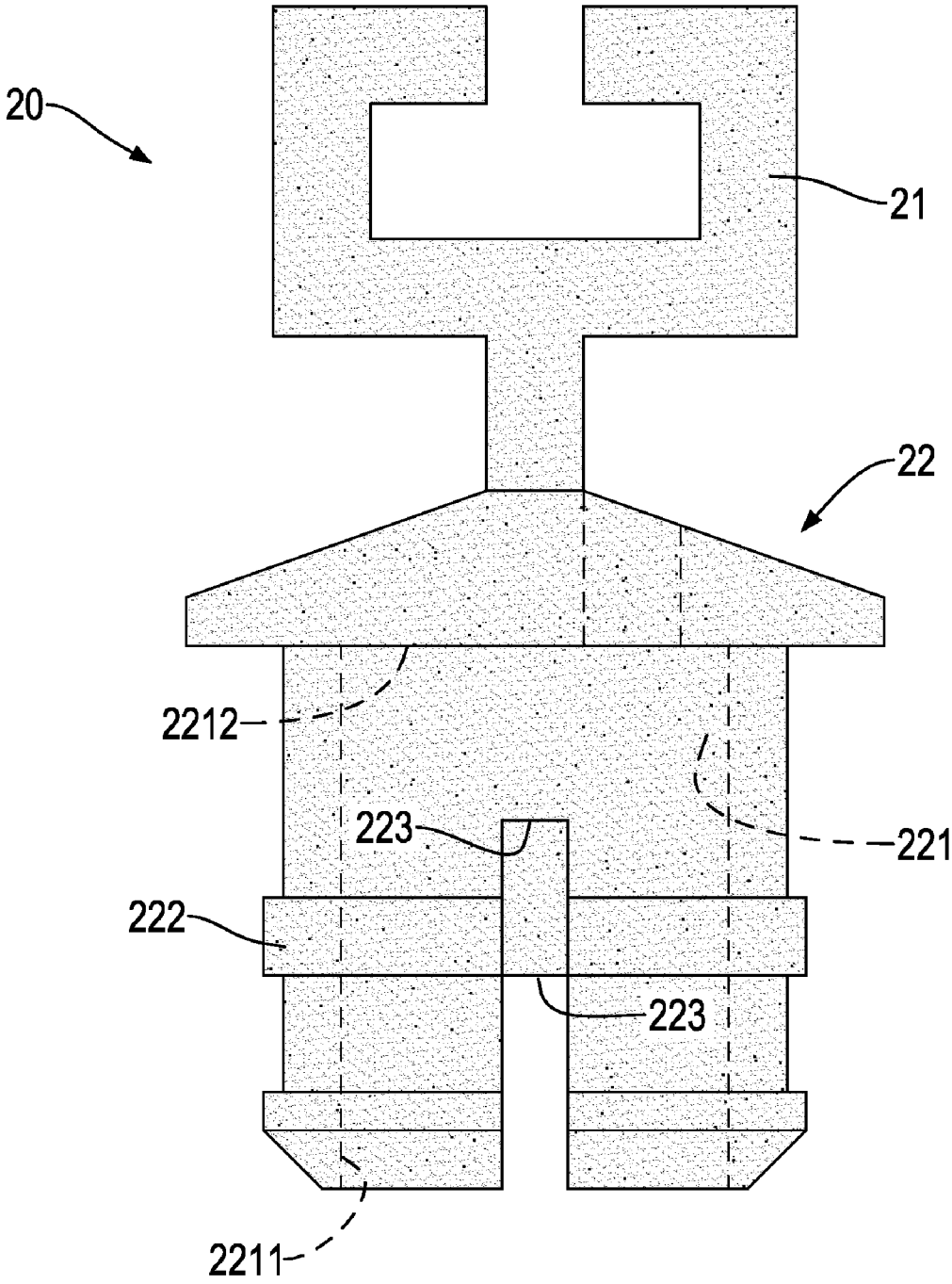
FIG. 8 is an enlarged side view of the bit socket mount of the bit socket bracket assembly in FIG. 7.
Figure 9:
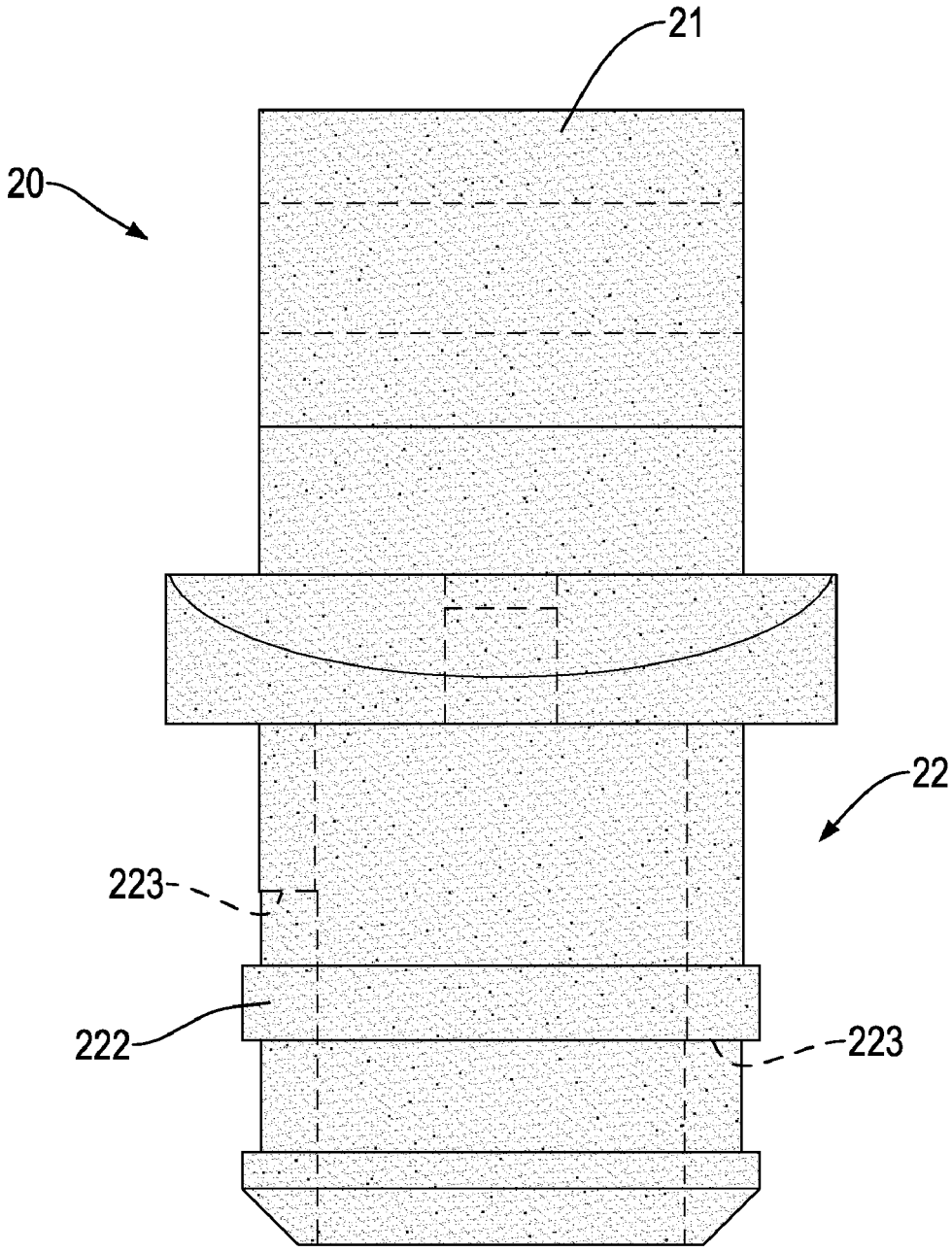
FIG. 9 is another enlarged side view of the bit socket mount of the bit socket bracket assembly in FIG. 7.

With further reference to FIGS. 2 to 4, the burglarproof unit 30 is connected with the bit socket mounts 20 and has multiple insertions 31. The insertions 31 are respectively mounted in the recesses 221. Each insertion 31 has an end and a barb 311. The barb 311 of each insertion 31 is formed on the end of the insertion 31, is mounted through a corresponding one of the bottoms 2212 of the recesses 221 and abuts a corresponding one of the positioning sections 22.

The two grooves 223 of each positioning section 22 may be respectively formed through the rib 222 of the positioning section 22. With the grooves 223, each positioning section 22 can be slightly squeezed and contracted to facilitate a positioning operation of the bit socket S that will be later described.

With reference to FIGS. 3 and 4, multiple bit sockets S are respectively and detachably mounted around the positioning sections 22 of the bit socket mounts 20. The bit sockets S can be rotated because the cross sections of the positioning sections 22 are round. Accordingly, a number or a sign on each bit socket S can be rotated to face a user.

When each bit socket S is inserted by the positioning section 22, the positioning section 22 is slightly and radially retracted by an inner surface of the bit socket S. Finally, the positioning section 22 recovers and the rib 222 is embedded in a recess of the inner surface of the bit socket S to position the bit socket S. Accordingly, the bit socket bracket assembly in accordance with the present invention can allow the bit sockets S to be rotated and also position the bit sockets S securely.

From the above description, it is noted that the present invention has the following advantage: the cross sections of the positioning sections 22 are round, so the bit sockets S can be rotated. Accordingly, a number or a sign on each bit socket S can be rotated to face a user and this is greatly practical and convenient.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A bit socket bracket assembly comprising:

a frame having a base having a hanging hole formed through the base;

an elongated arm integrally connected with the base; and an elongated track integrally connected with the arm;

multiple bit socket mounts detachably connected with the frame, each bit socket mount having a connecting section slidably mounted on the track;

a hollow positioning section integrally connected with the connecting section of the bit socket mount and having an end surface opposite to the connecting section of the bit socket mount;

an outer surface;

a round cross section;

a recess axially formed in the end surface of the positioning section and having a round cross section;

an opening; and a bottom opposite to the opening of the recess and adjacent to the connecting section;

an annular rib formed around the outer surface of the positioning section; and two grooves formed in the end surface of the positioning section, communicating with the recess and respectively located at two opposite sides of the positioning section, wherein one of the two grooves of the positioning section is formed through the rib; and a burglarproof unit connected with the bit socket mounts and having multiple insertions respectively mounted in the recesses, each insertion having an end; and a barb formed on the end of the insertion, mounted through a corresponding one of the bottoms of the recesses and abutting a corresponding one of the positioning sections.

2. The bit socket bracket assembly as claimed in claim 1, wherein the two grooves of each positioning section are respectively formed through the rib of the positioning section.

* * * * *